US009144920B1

(12) United States Patent
Urbina

(10) Patent No.: US 9,144,920 B1
(45) Date of Patent: Sep. 29, 2015

(54) RETAINER APPARATUS

(71) Applicant: Leo Urbina, Ft. Lupton, CO (US)

(72) Inventor: Leo Urbina, Ft. Lupton, CO (US)

( * ) Notice: Subject to any disclaimer, the term of this patent is extended or adjusted under 35 U.S.C. 154(b) by 0 days.

(21) Appl. No.: 14/205,375

(22) Filed: Mar. 12, 2014

(51) Int. Cl.

| | |
|---|---|
| ***B28B 7/02*** | (2006.01) |
| ***E04G 17/14*** | (2006.01) |
| ***B28B 7/00*** | (2006.01) |
| ***E01C 19/48*** | (2006.01) |

(52) U.S. Cl.
CPC ..... *B28B 7/0014* (2013.01); *E01C 19/4886* (2013.01)

(58) Field of Classification Search
USPC ..... 249/2, 4, 5, 8, 14, 188, 216; 404/2, 72, 404/98; 52/699, 475.1
IPC B28B 7/02,7/225; E01C 11/223; E04G 13/062, E04G 11/36, 17/02, 17/04, 17/14, 19/003
See application file for complete search history.

(56) References Cited

U.S. PATENT DOCUMENTS

| | | | | | |
|---|---|---|---|---|---|
| 1,279,059 | A | * | 9/1918 | Whiteway et al. | 249/8 |
| 1,547,036 | A | * | 7/1925 | Hedrick | 425/218 |
| 2,180,842 | A | * | 11/1939 | Winding | 249/5 |
| 2,586,912 | A | * | 2/1952 | Braun | 249/8 |
| 3,347,514 | A | * | 10/1967 | Yates | 249/2 |
| 3,428,287 | A | * | 2/1969 | Redding et al. | 249/13 |
| 4,192,625 | A | * | 3/1980 | Peletz | 404/5 |
| 5,720,467 | A | * | 2/1998 | Del Zotto | 249/155 |

* cited by examiner

*Primary Examiner* — Gary Hartmann
(74) *Attorney, Agent, or Firm* — Roger A. Jackson

(57) ABSTRACT

A retainer apparatus and method is disclosed for retaining a form mold on a surface, the form mold includes a front form, a back form, and a face form that are all parallel to one another. The apparatus includes a planar beam having a leg end portion, an opposing riser end portion, and a transition portion positioned therebetween. Also included is a foot extension that is slidably coupled to the leg end portion, allowing a selectable lengthening of the beam that engages the front form. Also included in the apparatus is an arm that is rotatably coupled to the riser end portion, the arm retains the face form in position against the transition portion, wherein the riser end portion also retains the back form.

17 Claims, 12 Drawing Sheets

RETAINER APPARATUS

TECHNICAL FIELD

The present invention generally relates to a retainer apparatus for a mold, and more particularly to a retainer apparatus that can bracket, clamp, and separate portions of the mold, wherein the retainer apparatus can quickly, efficiently, and easily be put into a locked state of engagement to support the mold portions and to subsequently be quickly, efficiently, and easily be put into a free state of disengagement to be removed from the mold portions.

BACKGROUND OF INVENTION

It is customary practice in the construction industry related to the forming of a concrete structure to rely upon a mold of some type to form a desired volumetric cavity for the concrete to be disposed into and subsequently the concrete curing into the desired shape to form a concrete structural element. This necessitates the creating or assembling of a number of various molds and a multitude of desired shapes and then subsequently disassembling these molds after the concrete has been disposed into or poured into the uniquely shaped mold and cured sufficiently after some passage of time. Thus, in the construction industry related to the forming of a desired concrete structural shape there is considerable repetitive assembly and disassembly of the molds leading to the desire on the part of the construction industry to make this mold assembly/disassembly process as easy as possible. Breaking this down further on this easy mold assembly/disassembly issue it would be further desired that a minimum of time is required, a minimum of tools are required, and a minimum of waste (i.e. consuming disposables) is created.

As an example, in concrete gutter work a "skeleton plate" is used to hold three different lateral forms that can be termed a back form (a double height form), termed a front form (a half height form), and termed a face form (a half height form), so in finished form the gutter back form surface is adjacent to a sidewalk, the from form surface is adjacent to a road surface, and the face form is what is exposed, being typically called "a gutter" as the step upward between the street surface and the sidewalk surface. The skeleton plate in operational to structurally position the front form, the back form, and the face form in a fixed relationship to one another, thus the skeleton place is oriented perpendicularly to the front, back, and face forms, wherein a plurality of skeleton plates are positioned parallel to one another about every linear ten feet or so to hold the relationship as between the front, back, and face forms that extend linearly or laterally for typically hundreds of feet. The other purpose for the skeleton plate is to create proper scoring of the concrete, thus the skeleton plate forms a division plane therethrough the gutter that is perpendicular to the linear or lateral extension of the gutter, the division plane facilitates controlled cracking of the gutter extension due to soil shifting and sinking.

The skeleton plates typically extend partially through the entire cross section of the gutter thus creating a crack line via leaving a "score" channel in about the top one-fourth of the gutter thickness extending from the upper surface of the gutter toward the soil surface below the gutter. A division plate is a skeleton plate that extends the full vertical thickness of the gutter cross section so as to cause a full gutter cross section gap positioned perpendicular to the linear extension of the gutter. A face form lower portion is anchored to the skeleton plate, however, a face form upper portion is typically anchored to the back form via a curb-top spacer bracket that needs to have a "C" shape (with the open side facing downward) to allow concrete surface finish work underneath the spacer bracket, however the curb-top spacer brackets have the drawbacks of having to keep track of separable parts and having to be attached independently to the back form and the face form, causing extra time. As is known in the industry, anything requiring specific attachment, i.e. a bolt through a hole, is undesirable in concrete work as with dirt, sand, moisture, and a partially hardened concrete layer present, makes conventional attachment methods undesirable—this not requiring separate attachment hardware is highly desirable. As the fixed dimensional configuration of the skeleton plate essentially sets the gutter profile, a given skeleton plate can only make a single size of gutter cross-section, as typically the gutter height dimensions are fairly consistent, such as the step height from the street surface level to the sidewalk surface level, however, a platform distance, i.e. the distance as between the face form and the front form can vary in requirements, wherein a conventional skeleton plate has this distance fixed.

In looking at the prior art in this area in U.S. Pat. No. 6,866,239 to Miller, et al. disclosed is a concrete form assembly for forming a concrete structure during drying of the concrete. The form assembly in Miller is formed of an elongated plastic form having a front wall for engaging the concrete and a rear wall, wherein the front wall is spaced apart from the back wall to define a pocket for receiving at least one connecting member. The connecting member in Miller is secured in the pocket to project a distance beyond an end of the form with a slidable wedge type stake holder that may also be provided to slide in a C-shaped pocket in the form. The stake holder in Miller also has right and left flanges that are adjacent to engage the rear wall and at least one preformed nail hole is provided in each of the right and left flanges. See FIG. 12 in Miller for an example of the curb-top spacer bracket 71 that forms a "C" section with the open end facing downward, wherein the "C" section allows for open space to finish the surface of the curb-top with the curb-top spacer bracket being a separate piece.

Further, in the prior art in U.S. Pat. No. 7,185,875 to Jarrett disclosed is an adjustable template apparatus for setting up risers in the manufacturing of concrete steps for enhancing the speed of set up for risers with regard to level and spacing. The adjustable template apparatus in Jarrett for setting up risers in manufacturing concrete steps includes a horizontal member having a first end and a second end; a first vertical member operationally coupled to the first end of the horizontal member, which is extending downwardly from the horizontal member, and is used to selectively abut a lower most riser. Further, in Jarrett a riser positioning member is slidably coupled to an underside of the horizontal member and is positionable along a length of the horizontal member for selectively engaging a second riser; and a second vertical member is slidably coupled to the horizontal member and positionable along a length of the horizontal member, the second vertical member extends upwardly from the horizontal member and is user for selectively abutting a third riser.

Continuing in the prior art, in U.S. Pat. No. 4,846,437 to Fitzgerald disclosed is a mold supporting bracket for supporting concrete formwork upon a supporting surface, the concrete formwork being in the form of an elongate lipped-channel section of the type having a channel web, the front face of which forms a mold wall section. Fitzgerald includes channel flanges extending rearwardly along opposite edges of the channel web and opposed channel lips extending inwardly along the free edges of the channel flanges. The mold supporting bracket in Fitzgerald includes a rigid side wall having a front end portion which when pivoted about an axis normal to the channel web to incline the front end portion relative to the channel flanges is receivable between the channel flanges and the opposed channel lips. Fitzgerald also has an upper recess and a lower opposed recess extending inwardly from respective upper and lower edges of the front end portion and being engagable about the innermost edges of the opposed channel lips upon pivoting the front end portion about the axis so as to locate the lipped-channel section relative to the bracket. Further included in Fitzgerald is a support mounting adjacent the rear end of the side wall and engagable with the supporting surface to hold the bracket and the located lipped-channel section in a selected orientation relative to the supporting surface, the support mounting being in the form of an apertured integral base wall extending substantially perpendicularly from and along the lower edge of the side wall rearwardly of the front end portion. Essentially, Fitzgerald facilitates the nested stacking of lateral forms in building a vertical form wall.

Next, in the prior art in U.S. Pat. No. 4,775,131 to Baumgartner disclosed is an apparatus for making concrete forms for creating stairs. A substantially planar member in Baumgartner has a riser end and a pivot end substantially opposite the riser end and has a first side and second side. A pivot point in Baumgartner rotatably fixes the pivoting end to a stringer so that the riser end can pivot with respect to the pivot end. A riser support member in Baumgartner is mounted perpendicular to the planar member adjacent the riser end and extends to each side of the planar member. A kneeboard support in Baumgartner may be placed on both sides of the planar member so that a kneeboard may be placed between one apparatus and a corresponding apparatus on the other side of the stairs. Further, a scale in Baumgartner may be provided for positioning the apparatus with respect to the stringer to facilitate mounting subsequent apparatus to a given stringer, wherein the scale can facilitate the riser support member being selectively slanted to provide a constant toe-in or kick-back of the step.

Also, in the prior art in U.S. Pat. No. 7,172,364 to Nicholson disclosed is a dropped curb finisher (i.e. used for driveways) that is for use with a slip form type paving machine for forming continuous curbs and gutters. The dropped curb finisher in Nicholson has a vertical mounting plate, a finishing plate, an end plate, and a vibrator for imparting vibration to the end plate and the finishing plate. The finishing plate in Nicholson extends rearwardly from the bottom edge of the mounting plate and the end plate inclines upwardly from the end of the finishing plate remote from the mounting plate. In another embodiment in Nicholson, the present invention comprises a method of forming a dropped curb with a slip form paving machine for forming continuous curbs and gutters.

What is needed is a simplified retaining apparatus or more specifically a skeleton or full division plate having quick and easy assembly and disassembly, that includes the ability to have an adjustable platform distance and structure to hold the upper portion of the back form to the upper portion of the face form in alignment not requiring a separable curb top spacer bracket, where in the structure to hold the upper portion of the back form to the upper portion of the face form is integral to the skeleton plate eliminating the need for a separable curb top spacer bracket and any tools. This is to eliminate the requirement of any tools or other retaining structure that could be fouled by the presence of concrete, dirt, mud, sand, and moisture.

SUMMARY OF INVENTION

The present invention is a retainer apparatus for retaining a form mold on a surface; the form mold includes a front form, a back form, and a face form, wherein the front, back, and face forms are all parallel to one another along a form mold lengthwise axis. The retainer apparatus includes a planar beam having an "L" shape disposed within a first plane, the planar beam having a longitudinal axis and an approximately perpendicularly positioned riser axis. Wherein the longitudinal axis and the riser axis are both positioned within the first plane, the planar beam including a leg end portion, an opposing riser end portion, and a transition portion positioned therebetween the leg end portion and the riser end portion. The transition portion has a structure to removably engage a portion of the face form and the riser end portion including structure for removably engaging the back form.

Further included in the retainer apparatus is a foot extension that is slidably coupled to the leg end portion, wherein the foot extension has slidable movement within the first plane and along the longitudinal axis. The foot extension structurally allows a selectable lengthening of a first distance from the riser end portion toward the foot extension along the longitudinal axis; the foot extension terminates in a structure for removably engaging the front form.

Also included in the retainer apparatus is an arm that is rotatably coupled to the riser end portion, the arm having rotatable movement within the first plane, the arm has an open operational state and a closed operational state. The arm closed operational state retains an opposing portion of the face form in position against the transition portion, the arm open operational state operationally facilitates removal movement of the face form from the retainer apparatus.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
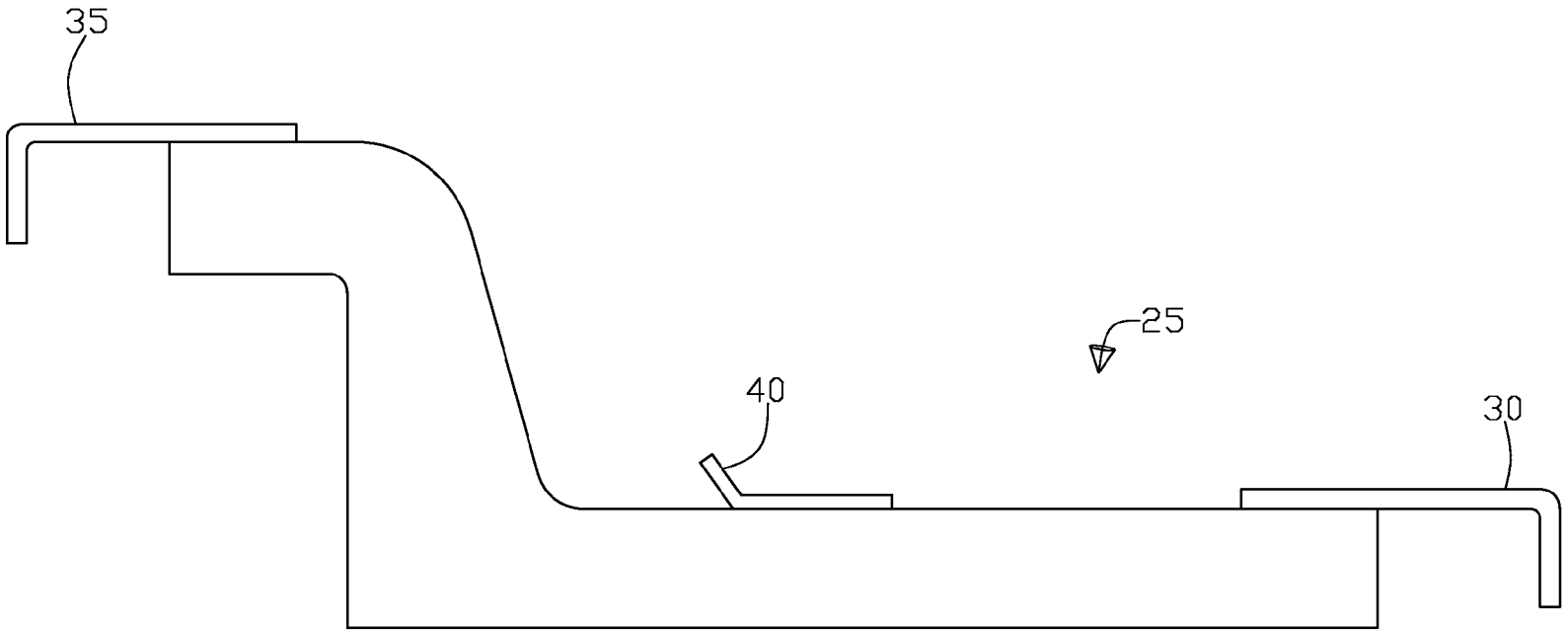
Fig. 1 (Prior Art)
FIG. 1 shows a side elevation view of the typical prior art in this area as what is termed in the prior art a skeleton plate for curb and gutter concrete forming, being a plate with a hook at each end and a tab at the middle, wherein the two hooks and tab secure front, back, and face forms respectively.

25 Skeleton plate (prior art)
30 Front form holder (prior art)
35 Back form holder (prior art)
40 Lower face form holder (prior art)
45 Upper face form holder (prior art)
50 Retainer apparatus
55 Form mold
60 Front form
65 Front gutter form
70 Portion of the front form 60
75 Back form
80 Back curb form
85 Face form
90 Portion of the face form 85
95 Opposing portion of the face form 85
100 Lengthwise axis of the form mold 55 or curb form mold
105 Parallel relationship of the form molds 55 including the back 75, front 60, and face 85 forms
110 Selected distance apart as between the front 60 and back 75 forms
115 Surface
120 Planar beam
125 "L" shape of the planar beam 120
130 First plane
131 Perpendicular relationship between the first plane 130 and the arm pivotal axis 430
135 Longitudinal axis
140 Riser axis
145 Approximate perpendicular position of longitudinal axis 135 and the riser axis 140 within the first plane 130
150 Leg end portion of the planar beam 120
155 Riser end portion of the planar beam 120
160 Termination of the riser end portion 155
165 Transition portion of the planar beam 120
170 Means to removably engage a portion 90 of the face form 85
175 Means for removably engaging the back form 75
180 Second hook of the riser end portion 155
185 Second arcuate structural shape of the second hook 180
190 Second open ended gap boundary
195 Encompassing of the portion of the back form 75 by the second open ended gap boundary 190
200 Angled tab
205 Acute angle formed as between the angled tab 200 and the transition portion 165
210 Acute angle facing the riser portion 155
215 Open wedge defined by the angled tab 200 and the transition portion 165 for receiving the portion 90 of the face form 85
220 Foot extension

Figure 3:
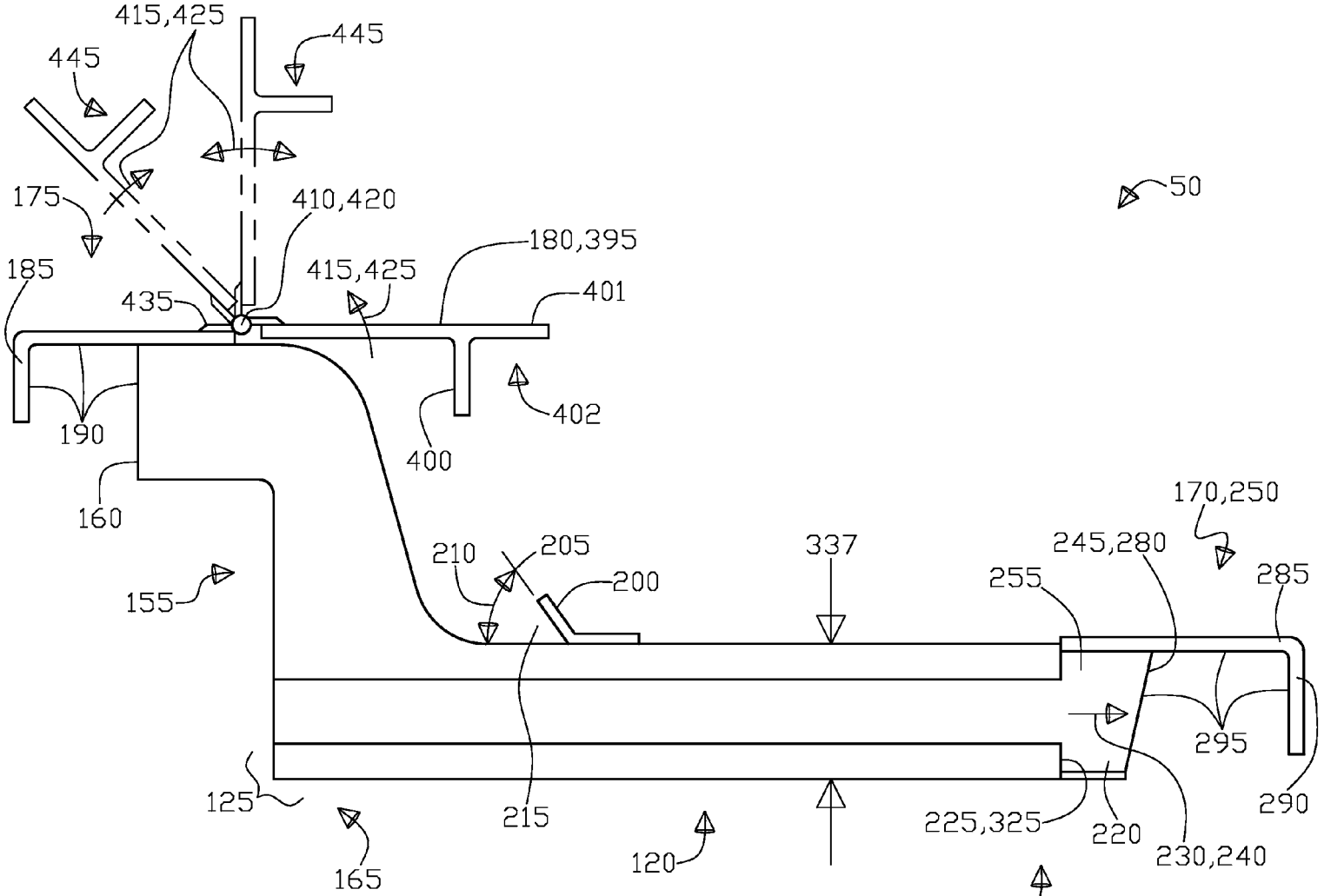
FIG. 3 shows a side elevation view of the present invention retainer apparatus that includes a second hook, a second arcuate shape of the second hook, a second open ended gap boundary, a rotatable couple, rotatable movement of the rotatable couple, a pivotal attachment, an affixment of the pivotal attachment, an arm, an angled finger termination of the arm, a hammer strikes protrusion, a hammer strike point, a termination of the riser end portion, a "L" shape of the planar beam, a riser end portion of the planar beam, a transition portion of the planar beam, an angled tab, an open wedge of the angled tab, an acute angle of the tab that faces the riser portion, a second dimension of the planar beam denoting a skeleton plate or a full division plate, a leg end portion of the planar beam, a plate, a foot extension, a slidable movement of the foot extension, a means to removably engage a portion of the face form, a termination of the foot extension, a termination of a distal end portion, a selectable lengthening of a first distance, a first open ended gap boundary, a first hook of the distal end portion, and a first arcuate shape of a first hook.
Figure 4:
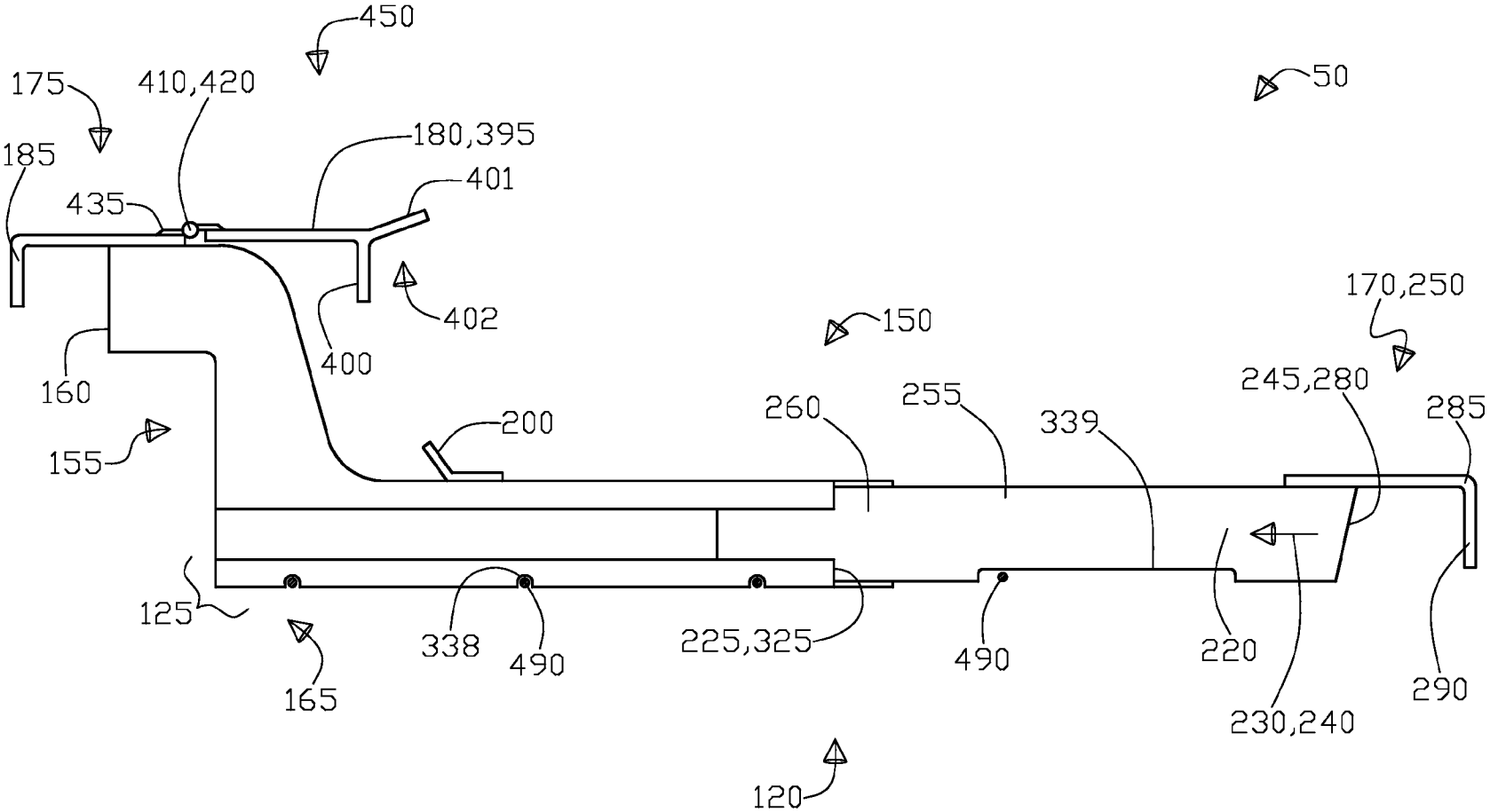
FIG. 4 also shows a side elevation view of the present invention retainer apparatus as shown in FIG. 3, however, with the selectable lengthening of the plate or foot extension shown extended to achieve a longer first distance, further in addition shown is a passage in the planar beam to accommodate a concrete reinforcing bar and a slot in the plate to accommodate concrete reinforcing bar and to also accommodate the same bar when the plate is slid to reduce the first distance.

225 Slidably coupled portion of the foot extension 220
230 Slidable movement of the foot extension 220
235 First distance
240 Selectable lengthening of the first distance 235
245 Termination of the foot extension 220
250 Means for removably engaging the front form 60 on the foot extension termination 245
255 Plate
260 Proximal end portion of the plate 255
265 Opposing large surfaces of the proximal end portion 260
270 Opposing small surfaces of the proximal end portion 260
275 Distal end portion of the plate 255
280 Termination of the distal end portion 275
285 First hook of the distal end portion 275
290 First arcuate structural shape of the first hook 285
295 First open ended gap boundary
300 Encompassing of the portion 70 of the front form 60 by the first open ended gap boundary 295
305 Void disposed in the leg end portion 150
310 Void being larger than the plate 255
320 Clearance between the void 305 and the plate 255
325 Slip fit relationship as between the void 305 and the plate 255
330 Surrounding sidewall of the void 305
331 Chute
332 Cantilever structures
333 External environment
335 Surrounding margin of the void 305
336 Residual concrete
337 Second dimension of the planar beam 120 that is parallel to the riser axis 140, wherein a shorter dimension 337 forms a skeleton planar beam 120 that is not in contact with the surface 115 and a longer dimension 337 forms a full division planar beam 120 that is in contact with the surface 115 as the retainer apparatus 50 can apply to either the skeleton plate planar beam 120 or the fill division plate planar beam 120
338 Passage in planar beam 120 for concrete 485 reinforcing bar 490
339 Slot in plate 255 for concrete 485 reinforcing bar 490
340 Short sides of the surrounding margin 335
345 Long sides of the surrounding margin 335
350 One long side extending beyond the short sides 340 and the long sides 345
355 Step formed from the one long side 350 and the short sides 340 and the remaining long side 345
360 Slidably received proximal end portion 260 into the void 305
365 Guide of proximal end portion 260 into the void 305 at the step 355
370 Rectangular cross section of the plate 255
375 Major axis of the plate 255
380 Minor axis of the plate 255
385 Perpendicular relationship of the major 375 and minor 380 axes
390 Parallel position of the major axis 375 and the longitudinal axis 135
395 Arm
400 Angled finger termination of the arm 395
401 Protrusion for hammer strikes 402 to move the arm 395 from the closed state 450 to the open state 445, note that the protrusion 401 can be angled away from the planar beam 120 as shown in FIG. 4 or in-line with the arm 395 as shown in FIG. 3
402 Hammer strike point
405 Removable engagement of the angled finger 400 to the opposing portion 95 of the face form 85
410 Rotatable couple of the arm 395
415 Rotatable movement of the rotatable couple 410 within the first plane 130
420 Pivotal attachment
425 Pivotal movement
430 Pivotal axis of the arm 395
435 Affixment of the pivotal attachment 420
440 Perpendicular position of the pivotal axis 430 to the longitudinal axis 135
445 Open operational state of the arm 395
450 Closed operational state of the arm 395
455 Retention of the opposing portion 95 of the face form 85 in position against the transition portion 165 by the arm 395 in the closed operational state 450
460 Face form 85 removal movement when the arm 395 is in the open operational state 445
465 Angle of less than one-hundred eighty (180) as between the major axis 375 and the longitudinal axis 135
470 Adjacent resting of the small surface 270 as against the short side 340 to the angle 465
475 Rotating the major axis 375 to be co-incident to the longitudinal axis 135
480 Pushing the proximal end portion 260 into the void 305
485 Concrete
490 Reinforcing bar for concrete 485

DETAILED DESCRIPTION

Figure 2:
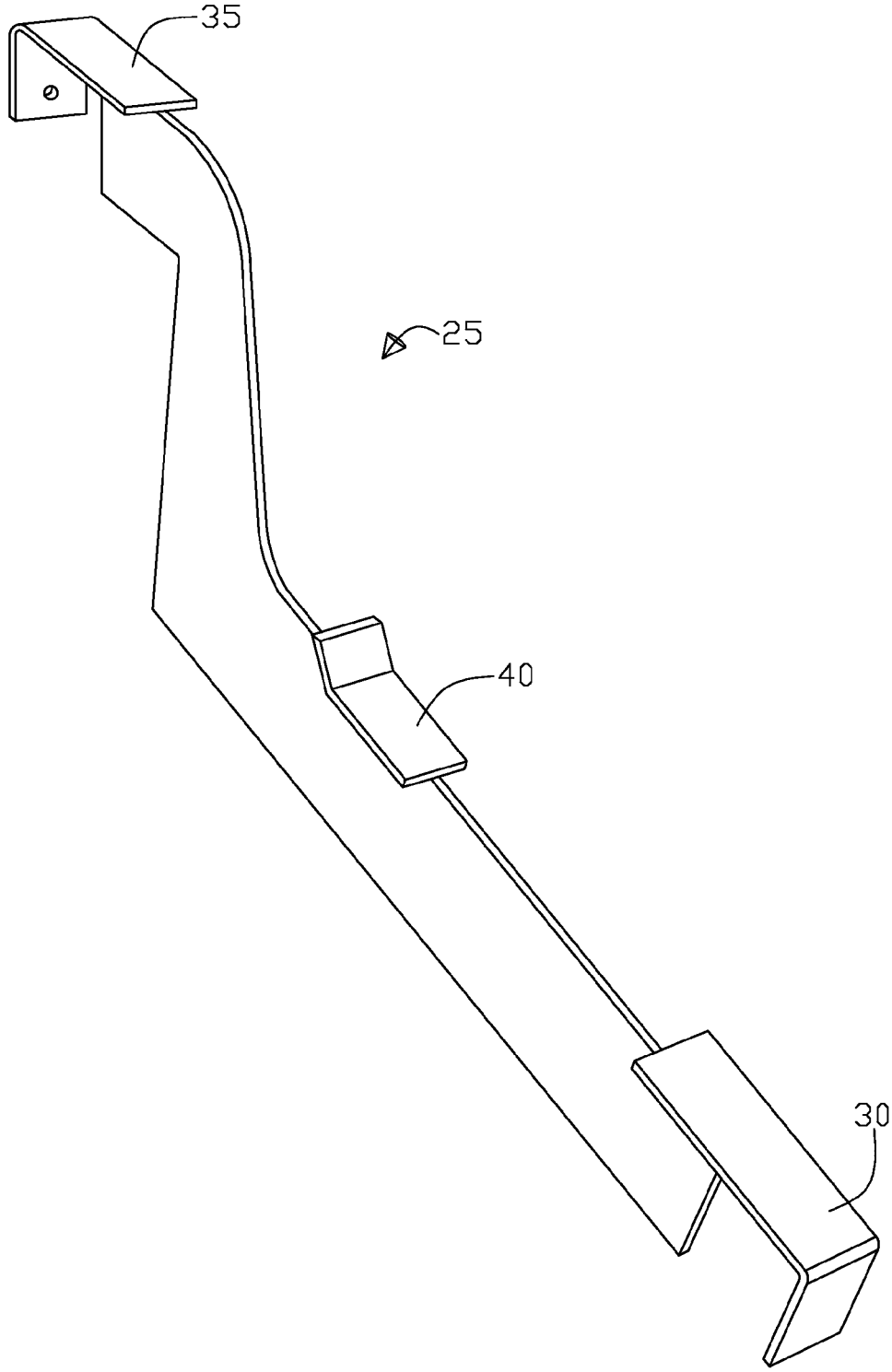
Fig. 2 (Prior Art)
FIG. 2 is a perspective view of FIG. 1 showing the skeleton plate for curb and gutter concrete forming, being the plate with the hook at each end and the tab at the middle, wherein the two hooks and tab secure the front, back, and face forms respectively.

With initial reference to FIG. 1, shown is a side elevation view of the typical prior art in this area as what is termed in the prior art a skeleton plate 25 for curb and gutter concrete forming, being a plate 25 with a hook at each end 30, 35 and a tab 40 at the middle, wherein the two hooks 30, 35 and tab 40 secure front 65, back 75, and face 85 forms respectively. FIG. 2 is a perspective view of FIG. 1 showing the skeleton plate 25 for curb and gutter concrete forming, being the plate 25 with the hook 30, 35 at each end and the tab 40 at the middle, wherein the two hooks 30, 35 and tab 40 secure the front 65, back 75, and face 85 forms respectively.

Moving on toward FIG. 3 shown is a side elevation view of the present invention retainer apparatus 50 that includes a second hook 180, a second arcuate shape 185 of the second hook 180, a second open ended gap boundary 190, a rotatable couple 410, rotatable movement 415 of the rotatable couple 410, a pivotal attachment 420, an affixment 435 of the pivotal attachment 420. Also shown in FIG. 3 is an arm 395, an angled finger termination 400 of the arm 395, a hammer strikes protrusion 401, a hammer strike point 402, a termination 160 of the riser end portion 155, a "L" shape 125 of the planar beam 120, a riser end portion 155 of the planar beam 120, a transition portion 165 of the planar beam 120.

Continuing in FIG. 3, shown is an angled tab 200, an open wedge 215 of the angled tab 200, an acute angle 205 of the tab 200 that faces 210 the riser portion 155, a second dimension 337 of the planar beam 120 denoting a skeleton plate or a full division plate, a leg end portion 150 of the planar beam 120. Further, FIG. 3 shows a plate 255, a foot extension 220, a slidable movement 230 of the foot extension 220, a means 170 to removably engage a portion of the face form 85, a termination 245 of the foot extension 220, a termination 280 of a distal end portion 275, a selectable lengthening 240 of a first distance 235, a first open ended gap boundary 295, a first hook 285 of the distal end portion 275, and a first arcuate shape 290 of a first hook 285.

Next, FIG. 4 also shows a side elevation view of the present invention retainer apparatus 50 as shown in FIG. 3, however, with the selectable lengthening 240 of the plate 255 or foot extension 220 shown extended to achieve a longer first distance 235. Further, in FIG. 4 additionally shown is a passage 338 in the planar beam 120 to accommodate a concrete reinforcing bar 490 and a slot 339 in the plate 255 to accommodate a concrete reinforcing bar 490 and to also accommodate the same bar 490 when the plate 255 is slid 360 to reduce the first distance 235.

Figure 5:
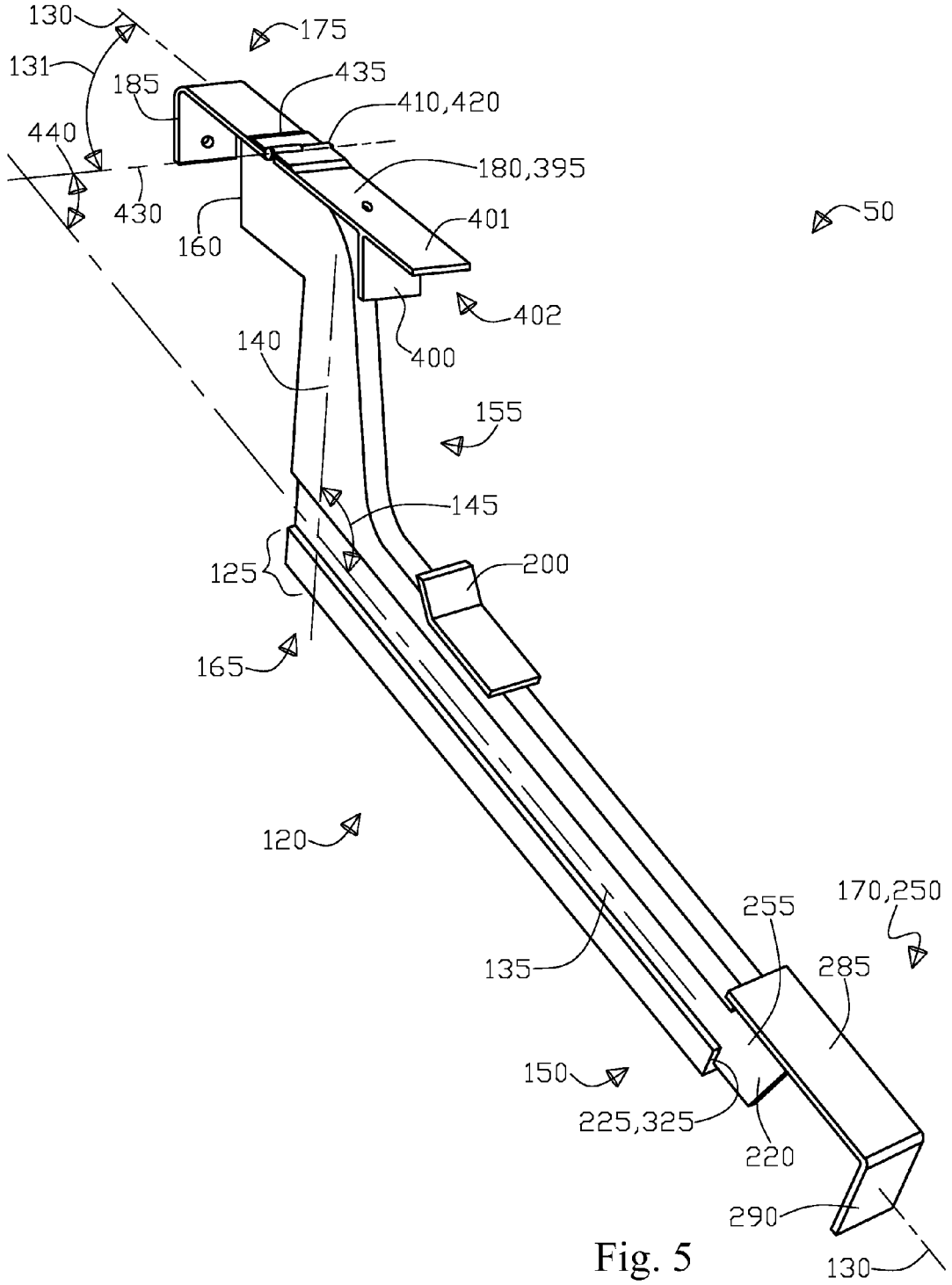
FIG. 5 shows a perspective view of the present invention retainer apparatus as shown in FIG. 3, with the addition of indicating a first plane that the rotatable movement operates in, a perpendicular position of the pivotal axis to the longitudinal axis, wherein the foot extension has slidable movement within the first plane.
Figure 6:
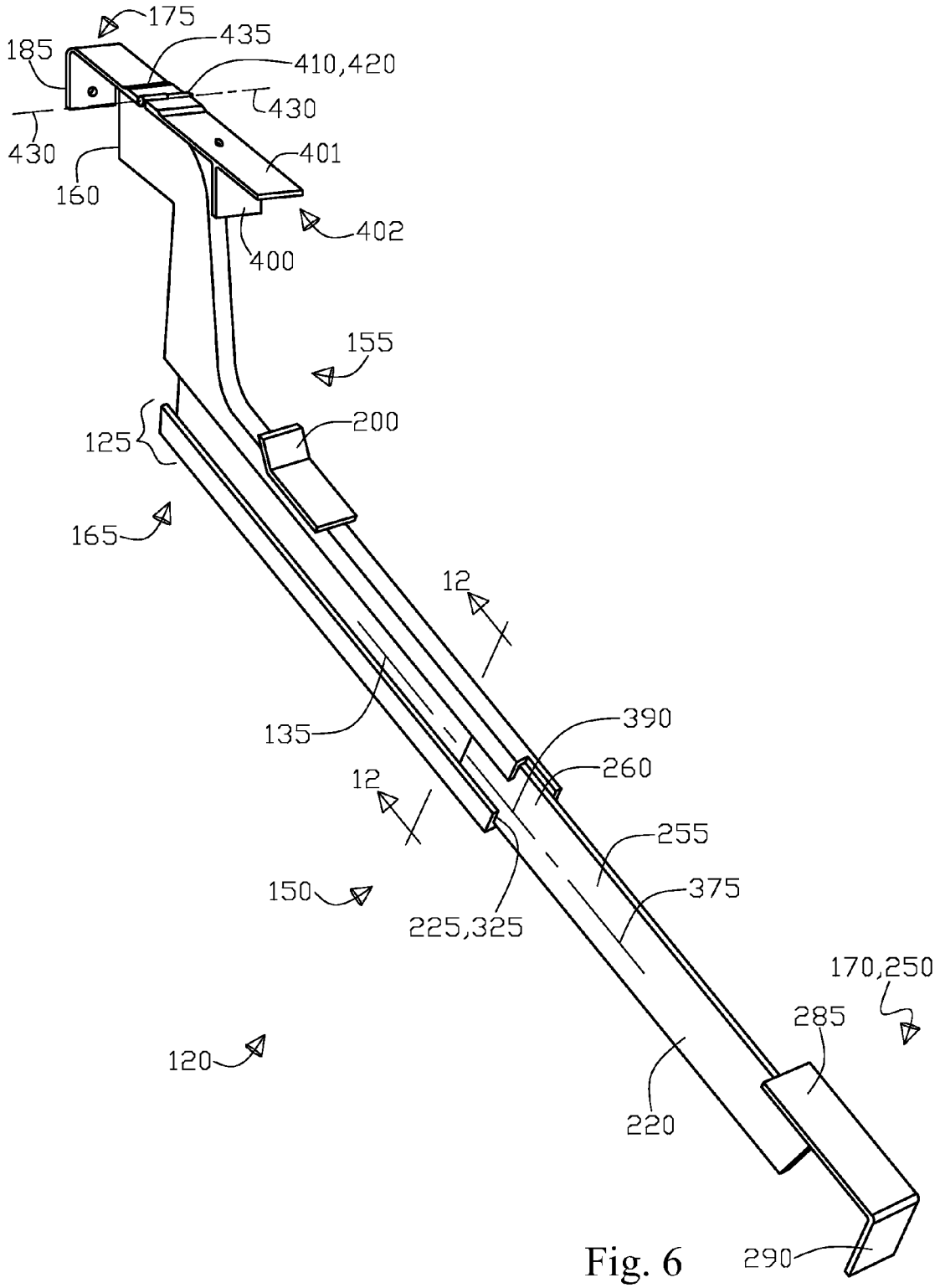
FIG. 6 shows a perspective view of the present invention retainer apparatus as shown in FIG. 3, with the plate and specifically the foot extension shown extended to achieve a longer first distance.

Continuing, in FIG. 5, shown is a perspective view of the present invention retainer apparatus 50 as shown in FIG. 3, with the addition of indicating a first plane 130 that the rotatable movement 415 operates in, a perpendicular position 440 of the pivotal axis 430 to the longitudinal axis 135, wherein the foot extension 220 has slidable movement 230 within the first plane 130. Looking next to FIG. 6 shown is a perspective view of the present invention retainer apparatus 50 as shown in FIG. 3, with the plate 255 and specifically the foot extension 220 shown extended to achieve a longer first distance 235.

Figure 7:
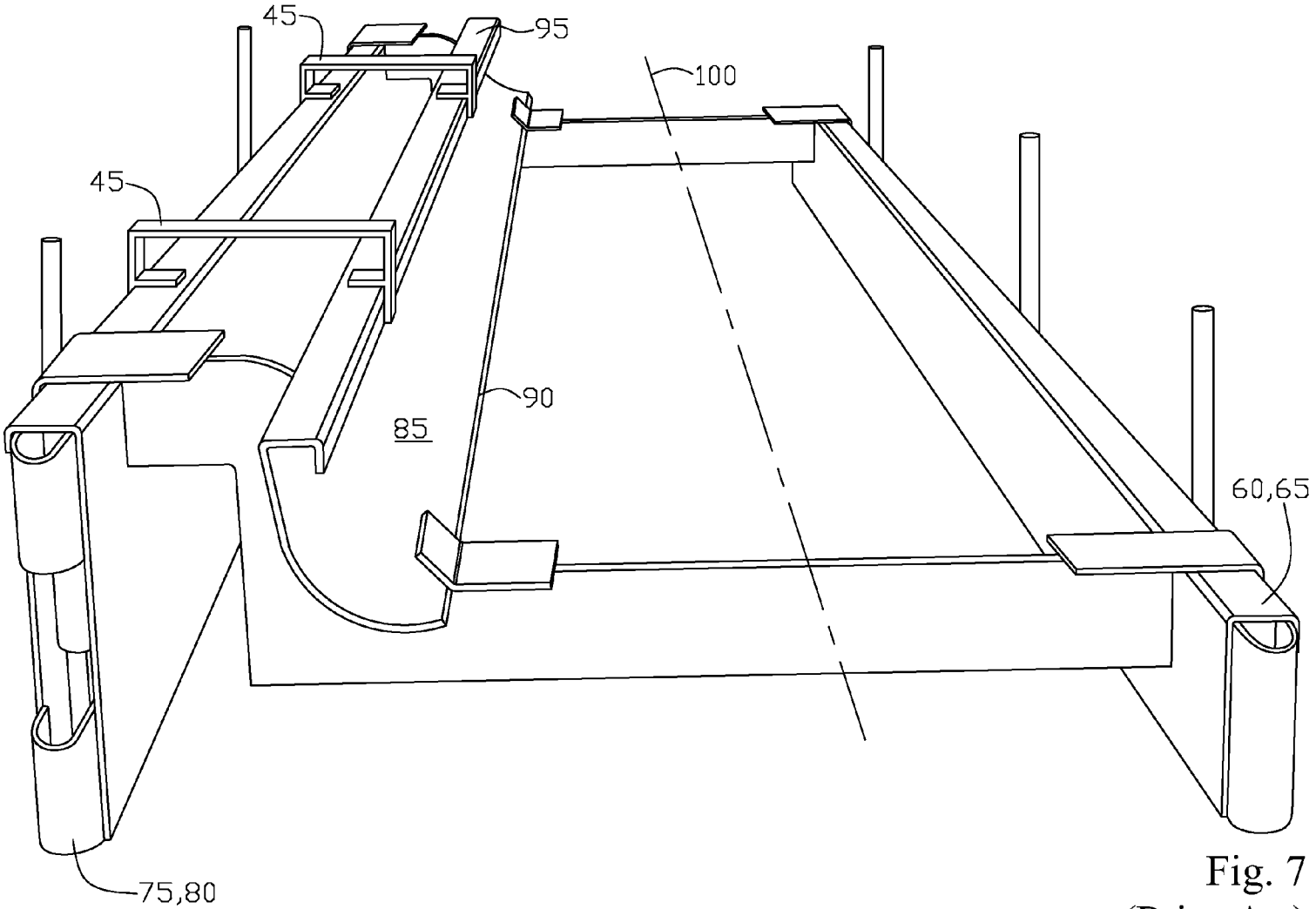
Fig. 7 (Prior Art)
FIG. 7 shows a side elevation perspective of the prior art skeleton plate installed and in use for curb and gutter concrete forming, being a plate with a hook at each end and a tab at the middle, wherein the two hooks and tab secure the front, back, and face forms respectively as shown.

Moving onward, FIG. 7 shows a side elevation perspective of the prior art skeleton plate 25 installed and in use for curb and gutter concrete forming, being a plate 25 with a hook 30, 35 at each end and a tab 40 at the middle, plus a separate upper face form holder 45, wherein the two hooks 30, 35, tab 40, and separate upper face form holder 45 secure the front 65, back 75, and face 85 forms respectively as shown.

Figure 8:
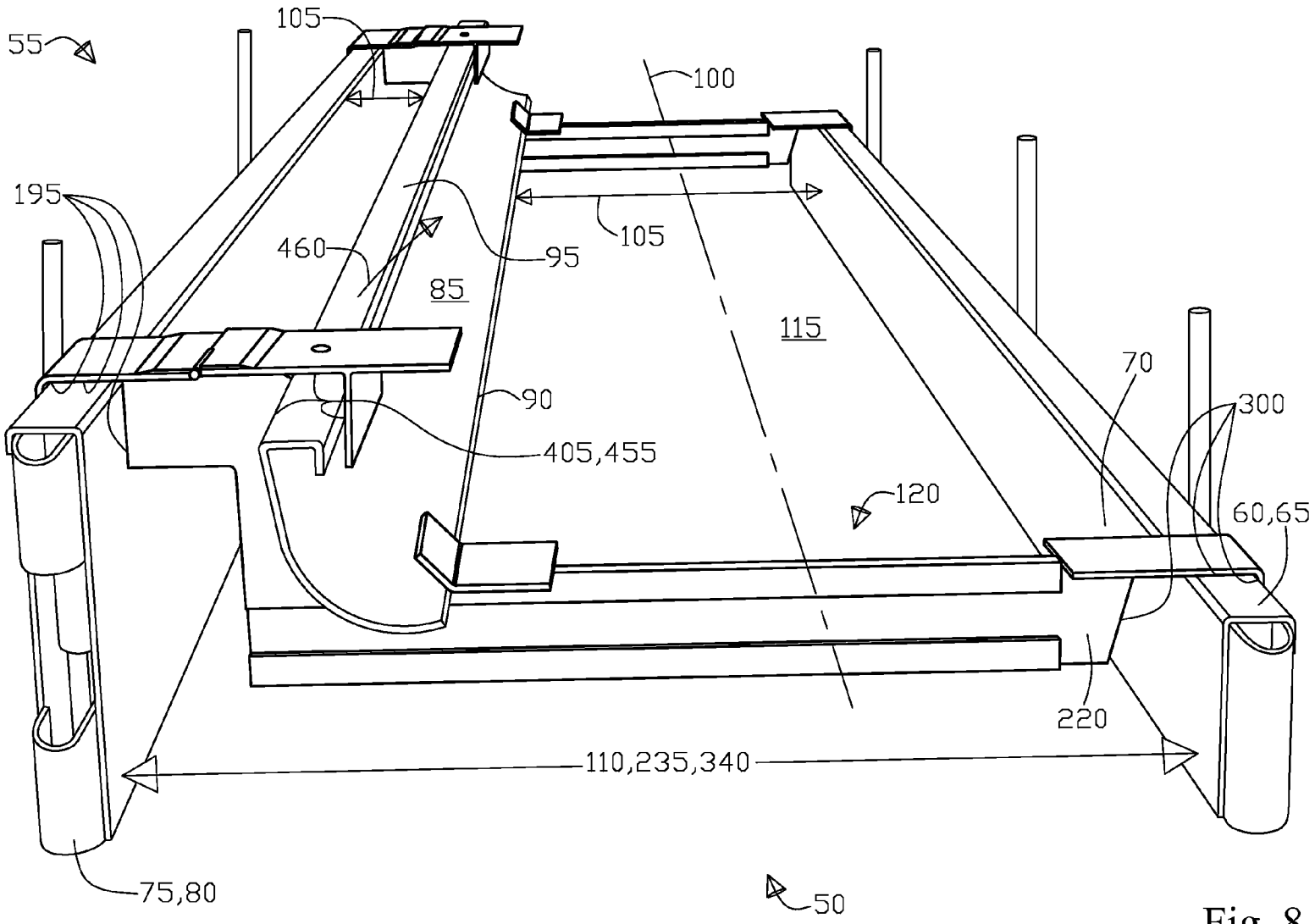
FIG. 8 shows a side elevation perspective of the present invention installed and in use for curb and gutter concrete forming to retain the form mold on a surface, the form mold includes a front form, a back form, and a face form, wherein the front, back, and face forms are all parallel to one another along a form mold lengthwise axis, wherein it can be seen that the back form is encompassed by the second open ended gap boundary, further the face form is shown with the removable engagement to the face form by the angled finger that retains the opposing portion of the face form in position as against the transition portion by the arm in the closed operational state, also the front form is retained via encompassing by the first open ended gap boundary, in addition the selectable first distance is shown as between the front and back forms, and the directional movement that the face form uses.

Next, FIG. 8 shows a side elevation perspective of the present invention 50 installed and in use for curb and gutter concrete forming to retain the form mold 55 on a surface 115, the form mold 55 includes a front form 60, a back form 75, and a face form 85, wherein the front 60, back 75, and face 85 forms are all parallel 105 to one another along a form mold 55 lengthwise axis 100. Wherein, in FIG. 8, it can be seen that the back form 75 is encompassed 195 by the second open ended gap boundary 190, further the face form 85 is shown with the removable engagement to the face form 85 by the angled finger 400 that retains the opposing portion 95 of the face form 85 in position as against the transition portion 165 by the arm 395 in the closed operational state 450. Also in FIG. 8, the front form 60 is retained via encompassing 300 by the first open ended gap boundary 295, in addition the selectable first distance 235 is shown as between the front 60 and back 75 forms, and the directional movement 460 that the face form 85 uses.

Figure 9:
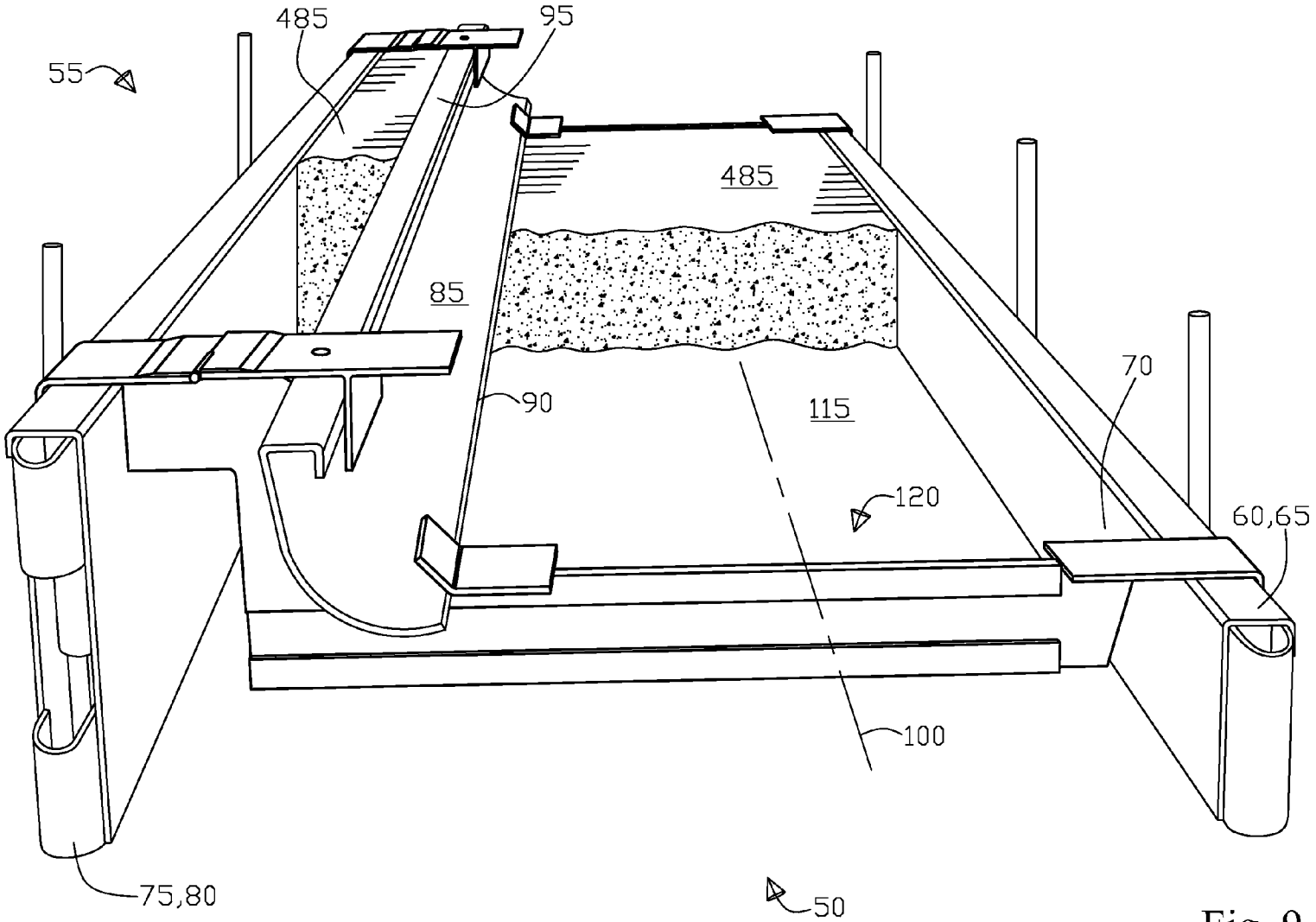
FIG. 9 shows a side elevation perspective of the present invention installed and in use for curb and gutter concrete forming from FIG. 8 with the addition of the concrete shown partially poured that indicates the general cross section configuration of the curb and gutter residing within the form mold includes the front form, the back form, and the face form.

Moving ahead, FIG. 9 shows a side elevation perspective of the present invention 50 installed and in use for curb and gutter concrete forming from FIG. 8 with the addition of the concrete 485 shown partially poured that indicates the general cross section configuration of the curb and gutter residing within the form mold 55 that includes the front form 60, the back form 75, and the face form 85. Continuing, FIG. 10 shows a perspective view specifically of the planar beam 120 with the longitudinal axis 135 at the leg end portion 150, the long sides 345 of the margin 335, the short sides 340 of the surrounding margin 335, the surrounding sidewall 330 of the void 305, the long side 345 of the surrounding margin 335, the surrounding margin 335 of the void 305, a step 355 formed from one long side 350 and the short sides 340 and the remaining long side 345, a chute 331, and the cantilever structures 332.

Figure 10:
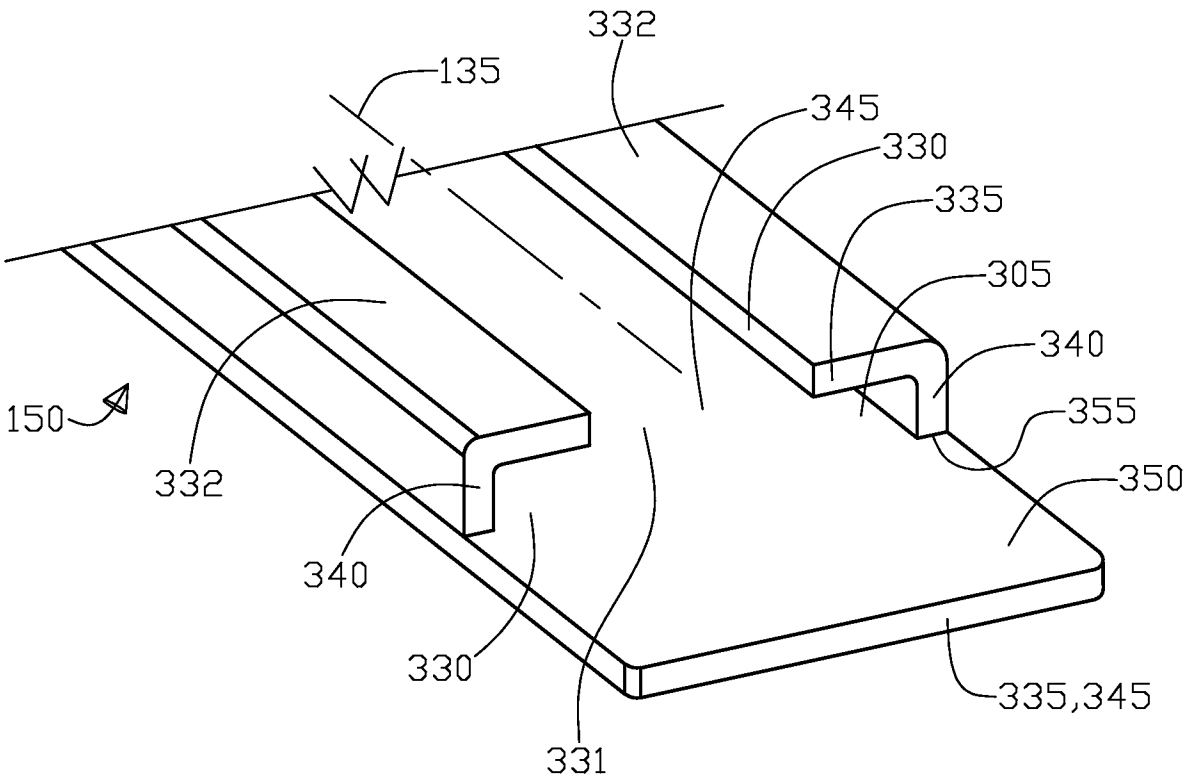
FIG. 10 shows a perspective view specifically of the planar beam with the longitudinal axis at the leg end portion, the long sides of the margin, the short sides of the surrounding margin, the surrounding sidewall of the void, the long side of the surrounding margin, the surrounding margin of the void, a step formed from one long side and the short sides and the remaining long side, a chute, and the cantilever structures.
Figure 11:
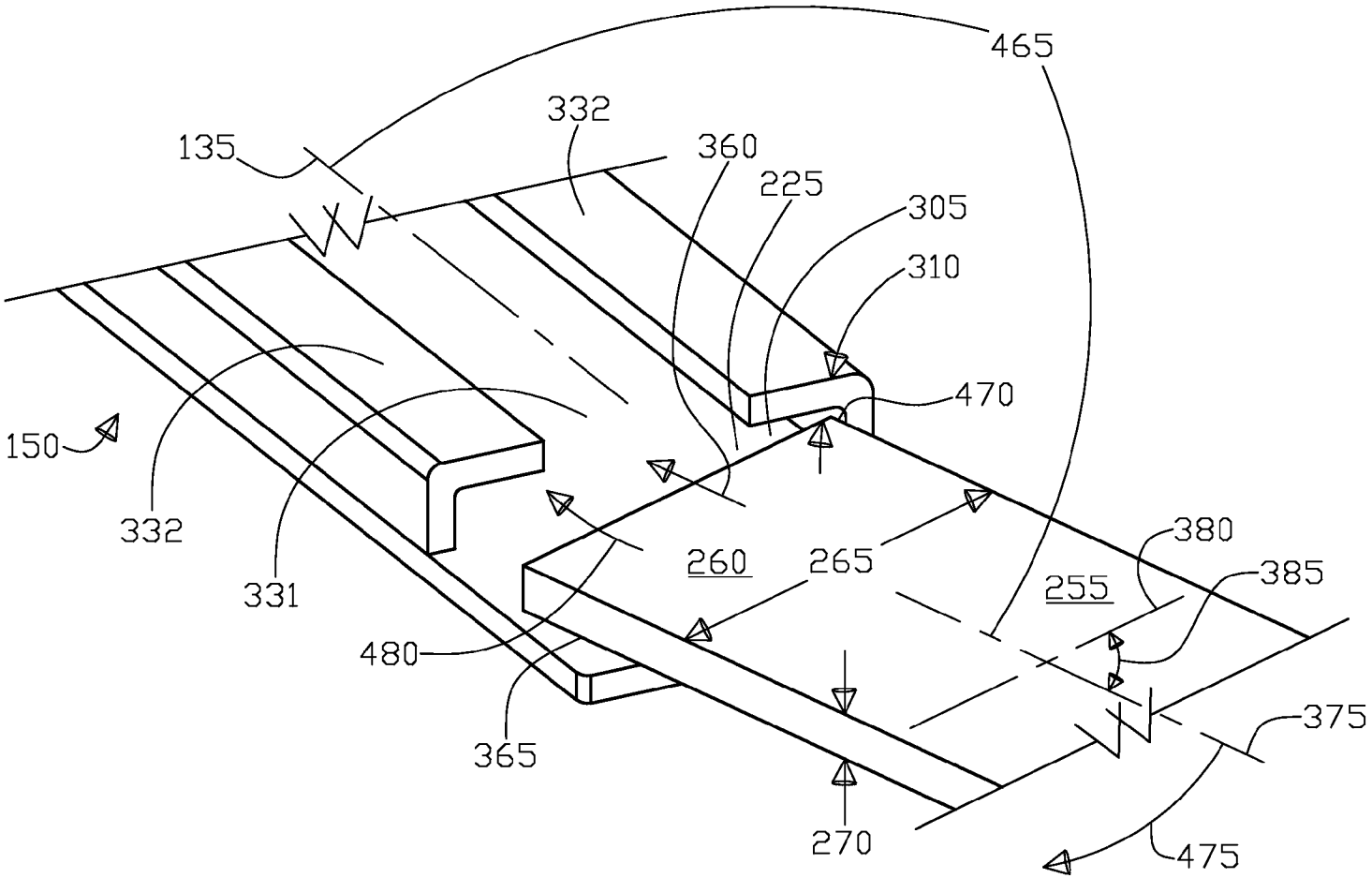
FIG. 11 shows the perspective view of FIG. 10 plus the plate proximal end portion being slidably received into the void at an angle of less than one-hundred and eighty degrees as between the major axis and the longitudinal axis, note that the opposing large surface of the proximal end portion is adjacent to the one long side extending forming the step wherein there is an adjacent resting of the small surface as against the short side to the angle, then rotating the major axis to be co-incident to the longitudinal axis and then pushing the proximal end portion into the void, this is to provide initial alignment to the slidably coupled proximal end portion to the void, as these elements are frequently dirty, muddy, and have concrete residue on them making the slidably coupled proximal end portion into the void difficult without using the step and angle first.

Next, FIG. 11 shows the perspective view of FIG. 10 plus the plate 255 proximal end portion 260 being slidably received 360 into the void 305 at an angle 465 of less than one-hundred and eighty degrees as between the major axis 375 and the longitudinal axis 135. Also in FIG. 11, note that the opposing large surface 265 of the proximal end portion 260 is adjacent to guide 365 to the one long side 350 extending forming the step 355 wherein there is an adjacent resting 470 of the small surface 270 as against the short side 340 to the angle 465. Further, FIG. 11 shows the rotating 475 the major axis 375 to be co-incident to the longitudinal axis 135 and then pushing 480 the proximal end portion 260 into the void 305. As FIG. 11 shows, this is to provide initial alignment to the slidably coupled 225 proximal end portion 260 into the void 305, as these elements are frequently dirty, muddy, and have concrete residue 336 on them making the slidably coupled 225 proximal end portion 260 into the void 305 difficult without using the step 355 and angle first 465.

Figure 12:
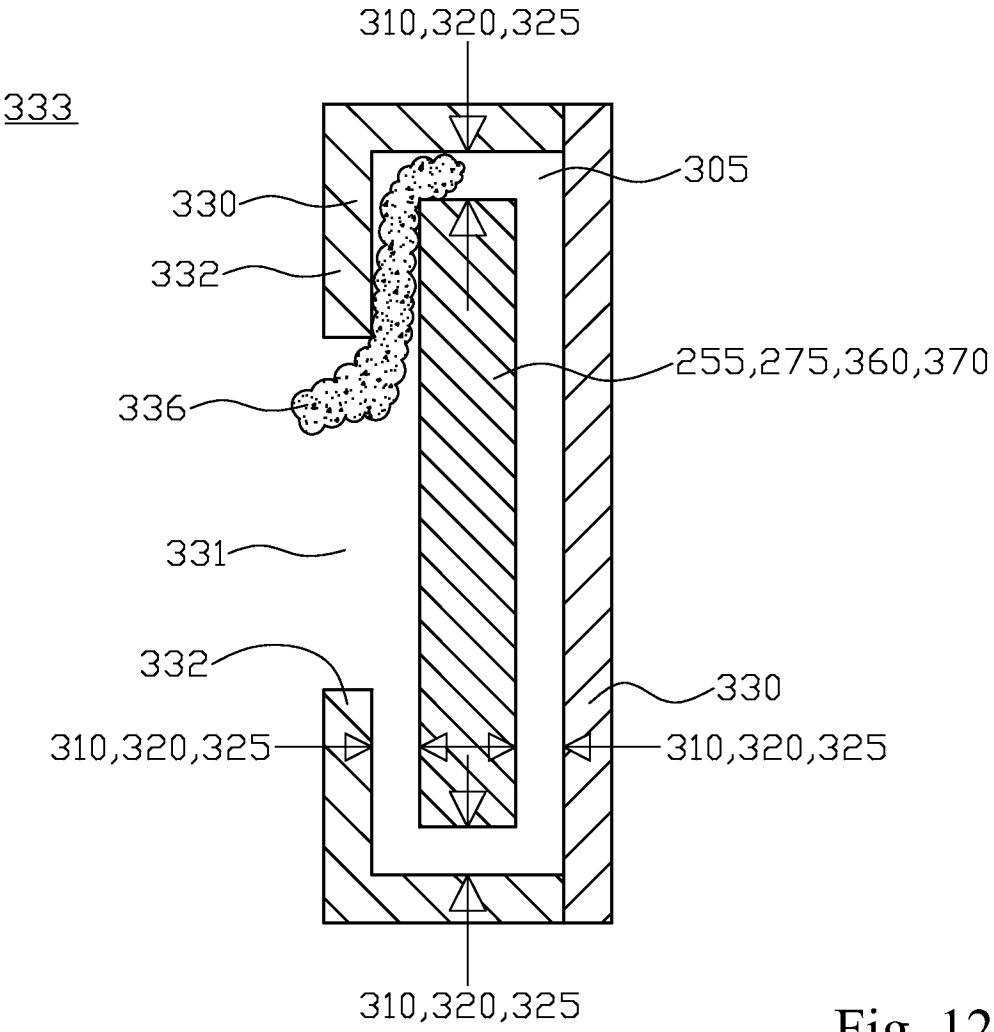
FIG. 12 is from cross section cut 12-12 as shown in FIG. 6, showing specifically the slidably coupled and received proximal end portion of the rectangular cross section plate within the void defined by the surrounding sidewall, with the slip fit relationship shown as between the proximal end portion and the void, wherein the void is larger than the proximal end portion shown to have a clearance as between the proximal end portion and the void as indicated by clearance between the void and plate, also shown in the chute that is defined by a pair of cantilever structures wherein the chute provides a communication outlet for residual concrete to the external environment that is trapped within the void to accommodate the slidably coupling between the proximal end portion and void.

Continuing, FIG. 12 is from cross section cut 12-12 as shown in FIG. 6, showing specifically the slidably coupled 225 and received 360 proximal end portion 260 of the rectangular 370 cross section plate 255 within the void 305 as defined by the surrounding sidewall 330, with the slip fit 325 relationship shown as between the proximal end portion 260 and the void 305. Wherein, in FIG. 12, the void 12 is larger 310 than the proximal end portion 260, and thus is shown to have a clearance 320 as between the proximal end portion 260 and the void 305 as indicated by clearance 320 between the void 305 and plate 255. Also, shown in FIG. 12 is the chute 331 that is defined by a pair of cantilever structures 332, wherein the chute 331 provides a communication outlet for residual concrete 336 to the external environment 333 that is trapped within the void 305 to accommodate the slidably coupling 225 between the proximal end portion 260 and void 305.

Broadly, in looking at FIGS. 3 to 6, the present invention is the retainer apparatus 50 is for retaining the form mold 55 on the surface 115, the form mold 55 includes the front form 60, the back form 75, and the face form 85, wherein the front 60, back 75, and face 85 forms are all parallel 105 to one another along the form mold 55 lengthwise axis 100. The retainer apparatus 50 includes a planar beam 120 having an "L" shape 125 disposed within the first plane 130, the planar beam 120 having a longitudinal axis 135 and an approximately perpendicularly positioned 145 riser axis 140. Wherein the longitudinal axis 135 and the riser axis 140 are both positioned within the first plane 130, the planar beam 120 including a leg end portion 150, an opposing riser end portion 155, and a transition portion 165 positioned therebetween the leg end portion 150 and the riser end portion 155. The transition portion 165 has a means 170 to removably engage a portion of the face form 85 and the riser end portion 155 including means 175 for removably engaging the back form 75.

Further included in the retainer apparatus 50 is a foot extension 220 that is slidably coupled 225 to the leg end portion 150, wherein the foot extension 150 has slidable movement 230 within the first plane 130 and along the longitudinal axis 135. The foot extension 150 structurally allows a selectable lengthening 240 of a first distance 235 from the riser end portion 155 toward the foot extension 150 along the longitudinal axis 135, the foot extension 150 terminates in a means 250 for removably engaging the front form 60, see in particular FIG. 8.

Looking in particular at FIGS. 3 to 6 and 8, also included in the retainer apparatus 50 is the arm 395 that is rotatably coupled 410 to the riser end portion 155, the arm 395 having rotatable movement 415 within the first plane 130, the arm 395 has an open operational state 445, see FIG. 3, and a closed operational state 450, see FIGS. 3 to 6, 8, and 9. The arm 395 closed operational state 450 retains 455 an opposing portion 95 of the face form 85 in position against the transition portion 165, the arm 395 open operational state operationally facilitates removal movement 460 of the face form 85 from the retainer apparatus 50, see in particular FIGS. 3 and 8.

Optionally, on the retainer apparatus 50 the rotatably coupled arm 395 is preferably constructed of a pivotal attachment 420 having pivotal movement 425 about an arm pivotal axis 430, wherein the pivotal attachment 420 is affixed 435 to the riser end portion 155, wherein the pivotal axis 430 is positioned perpendicular 440 to the longitudinal axis 135, wherein the arm 395 extends from the pivotal attachment 420 to terminate in an angled finger 400 that removably engages 405 the opposing portion 95 of the face form 85, as best shown in FIGS. 3 to 6, 8, and 9.

Also, optionally for the retainer apparatus 50 the slidably coupled 225 foot extension 220 is preferably constructed of a plate 255 having a rectangular cross section 370, wherein the plate 255 has a major axis 375 and a perpendicularly positioned 385 minor axis 380, the major axis 375 is positioned parallel 390 to the longitudinal axis 135. The plate 255 also having a proximal end portion 260 and an opposing distal end portion 275 that has the means 250 for removably engaging the front form 60, wherein the proximal end portion 260 is slidably received 360 in the leg portion 150 in a void 305 disposed within the leg portion 150, wherein the void 305 is larger 310 than the plate 255 by a clearance 320 to operationally facilitate a slip fit 325 relationship between the proximal end portion 260 and the leg portion 150, as best shown in FIGS. 3 to 6, and 10 to 12.

Further, optionally for the retainer apparatus 50 the void 305 is preferably defined by a surrounding sidewall 330, wherein the surrounding sidewall 330 terminates in a surrounding margin 335 having a pair of short sides 340 and a pair of long sides 345. Wherein one 350 of the long sides 345 extends beyond the pair of short sides 340 and a remaining long side 345 forming a step 355 in the surrounding margin 335 that is operational to guide 365 the plate 255 proximal end portion 260 into the void 305 to facilitate the slip fit 325 engagement, see in particular FIGS. 10 to 12.

Also, optionally for the retainer apparatus 50 wherein one of the long sides 345 further includes a chute 331 that runs parallel to the longitudinal axis 135, the chute 331 is defined by a pair of cantilever structures 332 that partially encompass the void 305. Wherein the chute 331 facilitates communication as between the void 305 and an external environment 333, wherein operationally the chute 331 allows residual concrete 336 to escape the void 305 to help accommodate the foot extension 220 to remain slidably coupled 225 to the leg end portion 150 therethrough the void 305, as best shown in FIG. 12 and referring to FIGS. 3 to 6 and 8 to 11.

Next, optionally for the retainer apparatus 50 for the means 250 for removably engaging the front form 60 is preferably constructed of a first hook 285 affixed to the distal end portion 275, the first hook 285 has a first arcuate structural shape 290 to form a first open ended gap boundary 295 defined by a termination 280 of the distal end portion 275 and the first arcuate structural shape 290, wherein operationally the first open ended gap boundary 295 encompasses 300 a portion 70 of the front form 60, as best shown in FIGS. 3 to 6, 8, and 9.

Again, optionally for the retainer apparatus 50 for the means 170 to removably engage a portion 90 of the face form 85 is preferably constructed of an angled tab 200 that forms an acute angle 205 with the transition portion 165 with the acute angle 205 facing 210 the riser portion 155, the tab 200 and the transition portion 165 defining an open wedge 215 for the portion 90 of the face form 85 to be received into, see in particular FIGS. 3 and 8.

Further, optionally for the retainer apparatus 50 on the means 175 for removably engaging the back form 75 is preferably constructed of a second hook 180 affixed to the riser end portion 155, the second hook 180 has a second arcuate structural shape 185 to form a second open ended gap boundary 190 defined by a termination 160 of the riser end portion 155 and the second arcuate structural shape 185, wherein operationally the second open ended gap boundary 190 encompasses 195 a portion of the back form 75, as best shown in FIGS. 3 and 8.

Note that the retainer apparatus 50 can be supplied separately, as shown in FIGS. 3 to 6, or in combination with the form mold 55 that includes the front form 60 or front gutter form 65, the back form 75 or the back curb form 80, and the face form 85, all as best shown in FIGS. 8 and 9.

Method of Use

Referring in particular to FIGS. 3 to 6 and 8 to 12, a method of using the retainer apparatus 50 is disclosed for creating the curb form mold 55 on the surface 115, which includes the steps of firstly providing the retainer apparatus 50 as previously described. Secondly, a step of positioning the front 60 and back 75 forms on the surface 115 to be located parallel 105 to one another at a selected distance apart 110 along a curb form mold lengthwise axis 100, see FIG. 8. Thirdly, a step of manually grasping the proximal end portion 260 of the foot extension 220 and the surrounding sidewall 330 of the leg end portion 150, see FIGS. 3 to 6.

Fourth, a step of positioning the large surface 265 of the proximal end portion 260 against the extended long side 350 of the surrounding margin 335 such that the major axis 375 is at an angle 465 of less than one-hundred eighty (180) degrees relative to the longitudinal axis 135 of the planar beam 120, see in particular FIGS. 10 and 11. Fifth, a step of resting 470 the small surface 270 of the proximal end portion 260 against the short side 340 of the surrounding margin 335 adjacent to the angle 465 of less than one-hundred eighty (180) degrees, as best shown in FIGS. 10 and 11. Sixth, a step of rotating 475 the major axis 375 to be co-incident to the longitudinal axis 135 while simultaneously pushing 480 the proximal end portion 260 into the void 305, as best shown in FIG. 11.

Seventh, a step of setting the selectable lengthening 240 of the first distance 235 such that the first open ended gap boundary 295 removably engages a portion 70 of the front form 60 and the second open ended gap boundary 190 encompasses 195 a portion of the back form 75, as best shown in FIG. 8. Step number eight is in rotating the arm 395 having rotatable movement 415 to the open operational state 445, see FIG. 3. A ninth step of positioning the face form 85 such that the portion 90 of the face form 85 is received into the open wedge 215, as best shown in FIGS. 3 and 8. A tenth step of rotating the arm 395 having rotatable movement 415 to the closed operational state 450 such that the angled finger 400 removably engages the opposing portion 95 of the face form 85.

CONCLUSION

Accordingly, the present invention of a retainer apparatus 50 has been described with some degree of particularity directed to the embodiment of the present invention. It should be appreciated, though; that the present invention is defined by the following claims construed in light of the prior art so modifications or changes may be made to the exemplary embodiment of the present invention without departing from the inventive concepts contained therein.

The invention claimed is:

1. A retainer apparatus for retaining a form mold on a surface, the form mold includes a front form, a back form, and a face form, wherein the front, back, and face forms are all parallel to one another along a form mold lengthwise axis, said retainer apparatus comprising:

(a) a planar beam having an "L" shape disposed within a first plane, said planar beam having a longitudinal axis and an approximately perpendicularly positioned riser axis, wherein said longitudinal axis and said riser axis are both positioned within said first plane, said planar beam including a leg end portion, an opposing riser end portion, and a transition portion positioned therebetween said leg end portion and said riser end portion, said transition portion has a means to removably engage a portion of the face form and said riser end portion including a means for removably engaging the back form;

(b) a foot extension that is slidably coupled to said leg end portion, wherein said foot extension has slidable movement within said first plane and along said longitudinal axis, said foot extension structurally allows a selectable lengthening of a first distance from said riser end portion toward said foot extension along said longitudinal axis, said foot extension terminates in a means for removably engaging the front form; and (c) an arm that is rotatably coupled to said riser end portion, said arm having rotatable movement within said first plane, said arm has an open operational state and a closed operational state, said arm closed operational state retains an opposing portion of the face form in position against said transition portion, said arm open operational state operationally facilitates removal movement of the face form from said retainer apparatus.

2. A retainer apparatus according to claim 1 wherein said rotatably coupled arm is constructed of a pivotal attachment having pivotal movement about an arm pivotal axis, wherein said pivotal attachment is affixed to said riser end portion wherein said pivotal axis is positioned perpendicular to said longitudinal axis and said first plane, wherein said arm extends from said pivotal attachment to terminate in an angled finger that removably engages the opposing portion of the face form.

3. A retainer apparatus according to claim 1 wherein said slidably coupled foot extension is constructed of a plate having a rectangular cross section, wherein said plate has a major axis and a perpendicularly positioned minor axis, said major axis is positioned parallel to said longitudinal axis, said plate having a proximal end portion and an opposing distal end portion that has said means for removably engaging the front form, said proximal end portion is slidably received in said leg portion in a void disposed within said leg portion, wherein said void is larger than said plate by a clearance to operationally facilitate a slip fit relationship between said proximal end portion and said leg portion.

4. A retainer apparatus according to claim 3 wherein said void is defined by a surrounding sidewall, wherein said surrounding sidewall terminates in a surrounding margin having a pair of short sides and a pair of long sides, wherein one of said long sides extends beyond said pair of short sides and a remaining long side forming a step in said surrounding margin that is operational to guide said plate proximal end portion into said void to facilitate said slip fit engagement.

5. A retainer apparatus according to claim 4 wherein one of said long sides further includes a chute that runs parallel to said longitudinal axis, said chute is defined by a pair of cantilever structures that partially encompass said void, wherein said chute facilitates communication as between said void and an external environment, wherein operationally said chute allows residual concrete to escape said void to help accommodate said foot extension to remain slidably coupled to said leg end portion.

6. A retainer apparatus according to claim 5 wherein said means for removably engaging the front form is constructed of a first hook affixed to said distal end portion, said first hook has a first arcuate structural shape to form a first open ended gap boundary defined by a termination of said distal end portion and said first arcuate structural shape, wherein operationally said first open ended gap boundary encompasses a portion of the front form.

7. A retainer apparatus according to claim 1 wherein said means to removably engage a portion of the face form is constructed of an angled tab that forms an acute angle with said transition portion with said acute angle facing said riser portion, said tab and said transition portion defining an open wedge for the portion of the face form to be received into.

8. A retainer apparatus according to claim 1 wherein said means for removably engaging the back form is constructed of a second hook affixed to said riser end portion, said second hook has a second arcuate structural shape to form a second open ended gap boundary defined by a termination of said riser end portion and said second arcuate structural shape, wherein operationally said second open ended gap boundary encompasses a portion of the back form.

9. A retainer apparatus for retaining a curb form mold on a surface, said retainer apparatus comprising:

(a) a front gutter form;

(b) a back curb form;

(c) a face form, wherein said front, back, and face forms are all positioned parallel to one another along a curb form mold lengthwise axis;

(d) a planar beam having an "L" shape disposed within a first plane, said planar beam having a longitudinal axis and an approximately perpendicularly positioned riser axis, wherein said longitudinal axis and said riser axis are both positioned within said first plane, said planar beam including a leg end portion, an opposing riser end portion, and a transition portion positioned therebetween said leg end portion and said riser end portion, said transition portion has a means to removably engage a portion of said face form and said riser end portion including a means for removably engaging said back form;

(e) a foot extension that is slidably coupled to said leg end portion, wherein said foot extension has slidable movement within said first plane and along said longitudinal axis, said foot extension structurally allows a selectable lengthening of a first distance from said riser end portion toward said foot extension along said longitudinal axis, said foot extension terminates in a means for removably engaging said front form; and (f) an arm that is rotatably coupled to said riser end portion, said arm having rotatable movement within said first plane, said arm has an open operational state and a closed operational state, said arm closed operational state retains an opposing portion of said face form in position against said transition portion, said arm open operational state operationally facilitates removal movement of said face form from said retainer apparatus.

10. A retainer apparatus according to claim 9 wherein said rotatably coupled arm is constructed of a pivotal attachment having pivotal movement about an arm pivotal axis, wherein said pivotal attachment is affixed to said riser end portion, wherein said pivotal axis is positioned perpendicular to said longitudinal axis and said first plane, wherein said arm extends from said pivotal attachment to terminate in an angled finger that removably engages said opposing portion of said face form.

11. A retainer apparatus according to claim 9 wherein said slidably coupled foot extension is constructed of a plate having a rectangular cross section, wherein said plate has a major axis and a perpendicularly positioned minor axis, said major axis is positioned parallel to said longitudinal axis, said plate having a proximal end portion and an opposing distal end portion that has said means for removably engaging said front form, said proximal end portion is slidably received in said leg portion in a void disposed within said leg portion, wherein said void is larger than said plate by a clearance to operationally facilitate a slip fit relationship between said proximal end portion and said leg portion.

12. A retainer apparatus according to claim 11 wherein said void is defined by a surrounding sidewall, wherein said surrounding sidewall terminates in a surrounding margin having a pair of short sides and a pair of long sides, wherein one of said long sides extends beyond said pair of short sides and a remaining long side forming a step in said surrounding margin that is operational to guide said plate proximal end portion into said void to facilitate said slip fit engagement.

13. A retainer apparatus according to claim 12 wherein one of said long sides further includes a chute that runs parallel to said longitudinal axis, said chute is defined by a pair of cantilever structures that partially encompass said void, wherein said chute facilitates communication as between said void and an external environment, wherein operationally said chute allows residual concrete to escape said void to help accommodate said foot extension to remain slidably coupled to said leg end portion.

14. A retainer apparatus according to claim 13 wherein said means for removably engaging the front form is constructed of a first hook affixed to said distal end portion, said first hook has a first arcuate structural shape to form a first open ended gap boundary defined by a termination of said distal end portion and said first arcuate structural shape, wherein operationally said first open ended gap boundary encompasses a portion of said front form.

15. A retainer apparatus according to claim 9 wherein said means to removably engage a portion of said face form is constructed of an angled tab that forms an acute angle with said transition portion with said acute angle facing said riser portion, said tab and said transition portion defining an open wedge for said portion of said face form to be received into.

16. A retainer apparatus according to claim 9 wherein said means for removably engaging said back form is constructed of a second hook affixed to said riser end portion, said second hook has a second arcuate structural shape to form a second open ended gap boundary defined by a termination of said riser end portion and said second arcuate structural shape, wherein operationally said second open ended gap boundary encompasses a portion of said back form.

17. A method of using a retainer apparatus for creating a curb form mold on a surface, comprising the steps of:

(a) providing a retainer apparatus that includes a front gutter form, a back curb form, a face form, a planar beam having an "L" shape disposed within a first plane, said planar beam having a longitudinal axis and an approximately perpendicularly positioned riser axis, wherein said longitudinal axis and said riser axis are both positioned within said first plane, said planar beam including a leg end portion, an opposing riser end portion, and a transition portion positioned therebetween said leg end portion and said riser end portion, said transition portion has an angled tab that forms an acute angle with said transition portion with said acute angle facing said riser portion, said tab and said transition portion defining an open wedge for a portion of said face form to be received into, and said riser end portion including a second hook affixed to said riser end portion, said second hook has a second arcuate structural shape to form a second open ended gap boundary defined by a termination of said riser end portion and said second arcuate structural shape, wherein operationally said second open ended gap boundary encompasses a portion of said back form, further included in said retainer apparatus is a foot extension that is slidably coupled to said leg end portion, wherein said foot extension has slidable movement within said first plane and along said longitudinal axis, said foot extension structurally allows a selectable lengthening of a first distance from said riser end portion toward said foot extension along said longitudinal axis, said foot extension having a proximal end portion and an opposing distal end portion, said proximal end portion having two opposing large surfaces and two opposing small surfaces, wherein said proximal end portion is slidably coupled to said leg end portion and said distal end portion terminates in a first hook affixed to said distal end portion, said first hook has a first arcuate structural shape to form a first open ended gap boundary defined by a termination of said distal end portion and said first arcuate structural shape, said first open ended gap boundary removably engages a portion of said front form, wherein said slidably coupled foot extension is constructed of a plate having a rectangular cross section, wherein said plate has a major axis and a perpendicularly positioned minor axis, said major axis is positioned parallel to said longitudinal axis, said proximal end portion is slidably received in said leg portion in a void disposed within said leg portion, wherein said void is larger than said plate by a clearance to operationally facilitate a slip fit relationship between said proximal end portion and said leg portion, wherein said void is defined by a surrounding sidewall, wherein said surrounding sidewall terminates in a surrounding margin having a pair of short sides and a pair of long sides, wherein one of said long sides extends beyond said pair of short sides and a remaining long side forming a step in said surrounding margin that is operational to guide said plate proximal end portion into said void to facilitate said slip fit engagement, also included is said retainer apparatus is an arm that is rotatably coupled in a pivotal attachment to said riser end portion, said arm having rotatable movement within said first plane, wherein said arm extends from said pivotal attachment to terminate in an angled finger that removably engages an opposing portion of said face form, said arm has an open operational state and a closed operational state, said arm closed operational state utilizes said angled finger to removably engage said opposing portion of said face form in position against said transition portion, said arm open operational state operationally facilitates removal movement of said face form from said retainer apparatus;

(b) positioning said front and back forms on the surface to be located parallel to one another at a selected distance apart along a curb form mold lengthwise axis;

(c) grasping said proximal end portion of said foot extension and said surrounding sidewall of said leg end portion;

(d) positioning said large surface of said proximal end portion against said extended long side of said surrounding margin such that said major axis is at an angle of less than one-hundred eighty (180) degrees relative to said longitudinal axis of said planar beam;

(e) resting said small surface of said proximal end portion against said short side of said surrounding margin adjacent to said angle of less than one-hundred eighty (180) degrees;

(f) rotating said major axis to be co-incident to said longitudinal axis while simultaneously pushing said proximal end portion into said void;

(g) setting said selectable lengthening of said first distance such that said first open ended gap boundary removably engages a portion of said front form and said second open ended gap boundary encompasses a portion of said back form;

(h) rotating said arm having rotatable movement to said open operational state;

(i) positioning said face form such that said portion of said face form is received into said open wedge; and (j) rotating said arm having rotatable movement to said closed operational state such that said angled finger removably engages said opposing portion of said face form.

* * * * *